US011596937B2

(12) United States Patent
Bartolucci et al.

(10) Patent No.: US 11,596,937 B2
(45) Date of Patent: Mar. 7, 2023

(54) DISPENSER FOR VISCOUS PRODUCTS

(71) Applicant: The Procter & Gamble Company, Cincinnati, OH (US)

(72) Inventors: Stefano Bartolucci, Singapore (SG); Nathan Daniel Grubbs, Moreland Hills, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 135 days.

(21) Appl. No.: 17/010,502

(22) Filed: Sep. 2, 2020

(65) Prior Publication Data

US 2021/0060544 A1 Mar. 4, 2021

Related U.S. Application Data

(60) Provisional application No. 62/894,864, filed on Sep. 2, 2019.

(51) Int. Cl.

| | |
|---|---|
| ***B01L 3/02*** | (2006.01) |
| ***B65D 47/18*** | (2006.01) |
| ***B65D 47/06*** | (2006.01) |

(52) U.S. Cl.

CPC ..... *B01L 3/0293* (2013.01); *B01L 3/0282* (2013.01); *B65D 47/06* (2013.01); *B65D 47/18* (2013.01)

(58) Field of Classification Search

CPC ..... B01L 3/0293; B01L 3/0282; B65D 47/06; B65D 47/18; B65D 51/24; A45D 2200/056; A45D 34/04

See application file for complete search history.

(56) References Cited

U.S. PATENT DOCUMENTS

| | | | | |
|---|---|---|---|---|
| 2009/0269229 | A1* | 10/2009 | Yeo | F04B 45/02 417/480 |
| 2013/0074983 | A1* | 3/2013 | Choi | A45D 34/00 141/23 |
| 2014/0234007 | A1* | 8/2014 | Lee | B65D 51/32 401/121 |
| 2015/0144663 | A1* | 5/2015 | Noel | A45D 34/00 222/383.1 |
| 2015/0232240 | A1* | 8/2015 | Lee | B65D 43/0225 220/288 |
| 2017/0216141 | A1* | 8/2017 | Suzuki | B65D 51/32 |
| 2021/0060544 | A1* | 3/2021 | Bartolucci | B01L 3/0293 |
| 2021/0368963 | A1* | 12/2021 | Hwang | B65D 51/32 |

FOREIGN PATENT DOCUMENTS

EP 3001927 A1 4/2016

OTHER PUBLICATIONS

International Search Report and Written Opinion; Application Ser. No. PCT/US2020/048855; dated Oct. 23, 2020; 12 pages.

* cited by examiner

*Primary Examiner* — Bob Zadeh
(74) *Attorney, Agent, or Firm* — Alexandra S. Anoff

(57) ABSTRACT

A product dispenser with a reservoir adapted for a product and a cap. The reservoir has a protrusion and a piston engaging mechanism. The cap has a pipette, a piston configured to move to create a suction to draw the product through a lower end orifice of the pipette, a housing for the piston, a corresponding engaging mechanism, a button configured to dispense the product, and a chamber configured to change its volume depending on the movement of the piston and the movement of the button.

16 Claims, 9 Drawing Sheets

DISPENSER FOR VISCOUS PRODUCTS

FIELD OF THE INVENTION

The present invention relates to a product dispenser, comprising a cap and a reservoir for a product, wherein the reservoir has a protrusion and a piston engaging mechanism, wherein the cap has the followings: a pipette having an upper end orifice and a lower end orifice; a piston configured to move so as to create a suction to draw the product through the lower end orifice of the pipette of the product dispenser; a housing for the piston configured for the piston to slide between a high position and low position in the housing; a corresponding engaging mechanism configured to engage with the piston engaging mechanism of the reservoir, and also configured to move together with the piston; a button configured to dispense the product through the end orifice of the pipette, when the button is actuated; a chamber configured to change its volume depending on the movement of the piston and the movement of the button, wherein when the cap is capped on the reservoir in a direction of closing the product dispenser, the piston is moved by the protrusion, relatively to the housing to the high position in the housing, and the volume of the chamber decreases, wherein when the cap is uncapped on the reservoir in a direction of opening the product dispenser, the piston is moved relatively to the housing to a low position in the housing by the engagement of the piston engaging mechanism and the corresponding engagement mechanism, and the volume of the chamber increases, wherein this opening of the cap produces a suction of the product in the pipette, wherein when the button is actuated, the volume of the chamber decreases by which the product is dispensed from the pipette.

BACKGROUND OF THE INVENTION

A dispenser provided with a reservoir and a pipette fixed to a cap which has an push button for dispensing the product is known. A coil spring or an elastically deformable diaphragm allows product to be sucked into the pipette. However, depending on the dispenser structure and/or how strongly the product is sucked and dispensed, the amount of the dispensed product can be easily varied in such dispensers. Thus, there is a need to provide dispensers of viscous products with improved precision in dispensing.

Alternatively, dispensers to automatically fill the pipette with products has been proposed. For example, Chattel's US patent application publication No. 2015144663 A discloses a dispenser for viscous products, including: a container for a product, a sealing cap designed to be screwed onto the container, a pipette, and a piston capable of causing a suction of the product into the pipette, the dispenser being arranged such that, when the cap is screwed onto the container, the unscrewing of the cap in the direction of opening of the dispenser causes, by itself, a movement of the piston producing the suction.

However, the inventor of the present invention has found a need to provide a different dispenser structure from that disclosed in the above Chanel's US patent publication, for at least one of the followings:

dispensing a larger dose per stroke; and reducing the number of pieces used in the structure, by which the dispenser may provide improved stability in: sealing functions; and/or piston movements.

There is also a need to provide such dispensers without using plastic springs or bellows in view of prevention of failure of piston movement caused by creep/fatigue. Dispensers without any metal parts such as metal coil spring may also be desired in view of easiness to recycle plastic materials used in other parts of the dispenser. This enables material selection allowing the dispenser to be recycled according to one SPI class wherein each of the components is selected from the group consisting of a single class of recyclable materials as defined by the Society of the Plastics Industry.

Thus, there is a need for providing dispensers to meet at least one of the aforementioned needs.

SUMMARY OF THE INVENTION

The present invention is related to a product dispenser, comprising:

a reservoir for a product, having: a protrusion; and a piston engaging mechanism, a cap having the followings:

- a pipette having an upper end orifice and a lower end orifice;
- a piston configured to move so as to create a suction to draw the product through the lower end orifice of the pipette of the product dispenser;
- a housing for the piston configured for the piston to slide between a high position and low position in the housing;
- a corresponding engaging mechanism configured to engage with the piston engaging mechanism of the reservoir, and also configured to move together with the piston;
- a button configured to dispense the product through the end orifice of the pipette, when the button is actuated;
- a chamber configured to change its volume depending on the movement of the piston and the movement of the button, wherein when the cap is capped on the reservoir in a direction of closing the product dispenser, the piston is moved by the protrusion, relatively to the housing to the high position in the housing, and the volume of the chamber decreases, wherein when the cap is uncapped on the reservoir in a direction of opening the product dispenser, the piston is moved relatively to the housing to a low position in the housing by the engagement of the piston engaging mechanism and the corresponding engagement mechanism, and the volume of the chamber increases, wherein this opening of the cap produces a suction of the product in the pipette, wherein when the button is actuated, the volume of the chamber decreases by which the product is dispensed from the pipette.

This invention provides at least one of the followings:

improved precision in dispensing;

dispense of a larger dose per stroke;

improved stability in: sealing functions; and/or piston movements, due to reduced number of pieces used in the structure;

prevention of failure of piston movement caused by creep/fatigue, due to non-use of plastic springs or bellows;

easiness of recycling due to non-use of metal coil springs and being made from materials which can go into a single recycling stream having a single class of materials, as defined by the Society of Plastics Industry

DETAILED DESCRIPTION OF THE INVENTION

Figure 1:
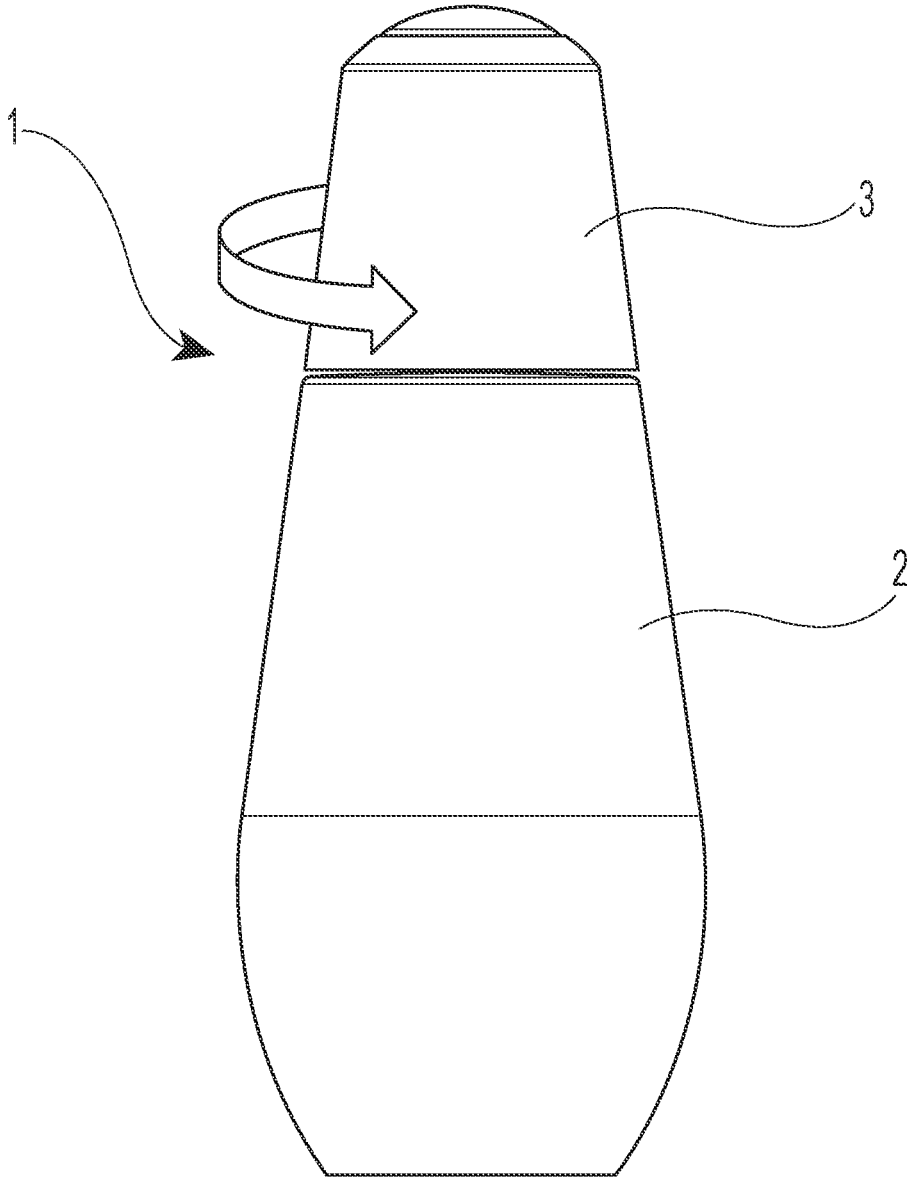
FIG. 1 illustrates a front view of a dispenser according to one embodiment of the present invention, in a cap-closed position.

The present invention relates to a product dispenser, comprising:

a reservoir for a product, having: a protrusion; and a piston engaging mechanism, a cap having the followings:

- a pipette having an upper end orifice and a lower end orifice;
- a piston configured to move so as to create a suction to draw the product through the lower end orifice of the pipette of the product dispenser;
- a housing for the piston configured for the piston to slide between a high position and low position in the housing;
- a corresponding engaging mechanism configured to engage with the piston engaging mechanism of the reservoir, and also configured to move together with the piston;
- a button configured to dispense the product through the end orifice of the pipette, when the button is actuated;
- a chamber configured to change its volume depending on the movement of the piston and the movement of the button, wherein when the cap is capped on the reservoir in a direction of closing the product dispenser, the piston is moved by the protrusion, relatively to the housing to the high position in the housing, and the volume of the chamber decreases, wherein when the cap is uncapped on the reservoir in a direction of opening the product dispenser, the piston is moved relatively to the housing to a low position in the housing by the engagement of the piston engaging mechanism and the corresponding engagement mechanism, and the volume of the chamber increases, wherein this opening of the cap produces a suction of the product in the pipette, wherein when the button is actuated, the volume of the chamber decreases by which the product is dispensed from the pipette.

Preferably, in the present invention, the reservoir also has a neck having the cap fastening mechanism on its outer surface, the protrusion is protruded upward from the neck, and the protrusion has the piston engaging mechanism.

Preferably in the present invention, the reservoir also has a cap fastening mechanism, and the cap also has a corresponding fastening mechanism configured to engage with the cap fastening mechanism on the reservoir. The cap fastening mechanism and the corresponding fastening mechanism can be anything, for example, screw threads and bayonet connecter, and are preferably screw threads in view of preventing leakages and/or drop of the cap from the reservoir especially during transportation.

The piston engaging mechanism and the corresponding engaging mechanism can be anything as long as the required functions are achieved, for example, snap fits (including latches) and magnets, and are preferably snap fits. The piston engaging mechanism at the reservoir engages with the corresponding engaging mechanism at the cap in a cap-closed position and a partially cap-open position, and disengages in a cap-open position. In a conventional manner, a dispenser with a cap is opened by uncapping. During uncapping, the piston engaging mechanism engages with the corresponding engaging mechanism, such that the vertical positioning of the piston and pipette do not change relative to the bottle.

In preferred embodiment, the cap can also have a containment ring configured to prevent accidental disengagement between the piston engaging mechanism and the corresponding engaging mechanism of the piston engaging mechanism by applying a containment pressure when the cap is in a close or partially open position, especially when the piston engaging mechanism and the corresponding engaging mechanism are snap fits.

In the dispenser of the present invention, during opening the cap, the position of the piston and then of the pipette doesn't change relative to the bottle. This assures that the pipette always sucks-up the product consistently with the pipette lower end orifice positioned at a minimal distance from the bottle inside bottom surface, i.e. at an optimal position and without any relative motion during product loading. This prevents the intrusion of any air bubble, and also ensures that the pipette is properly filled at the time the users picks the cap and dispenses.

In preferred embodiment, the button has a valve to release air when the piston moves from a lower position to a higher position in the housing.

In preferred embodiment, the volume changes of the chamber take place without coil spring or bellows. More preferably, the dispenser of the present invention is free of coil spring and bellows. By this, the mechanism housed in the cap is simplified, the number of components is reduced, the manufacturing of the dispenser is less expensive, and the assembly thereof is less complex. Further this design makes the cap easy to be recycled, especially allows the cap to be mechanically recycled. Metal coil springs typically included in dispensers are generally considered incompatible with the mechanical recycling process. Plastic coil springs and bellows could lead to designs compatible with mechanical recycling. However, plastic coil springs and bellows are found to cause dosage inconsistency due the inevitable creep and fatigue experienced both during storage and cycling load during usage.

The invention relates to a dispenser for viscous products such as gel, lotion, serum or essences, particularly useful in the field of beauty care products such as skin care and hair care. For example, the viscous product has a viscosity of between 5,000 and 35,000 centipoise, preferably between 10,000 and 20,000 centipoise (viscosity measured with the aid of a Brookfield LVT viscometer equipped with a spindle and rotating at a speed of three rotations per minute).

EXAMPLES

FIG. 1-FIG. 7 illustrate one embodiment of the dispenser of the present invention. In these figures, the dispenser 1 comprises a reservoir 2 (or bottle) on which a cap 3 is screwed. In this embodiment, the dispenser and most of its components have an overall shape which is symmetrical about an axis of the dispenser, but in other embodiments, some components for example, cover, bottle and/or pipette may not be symmetrical. In this embodiment, the dispenser does not have any coil spring or bellow.

The reservoir 2 contains a skin care product which is for example a viscous product, the viscosity of which is between 5,000 and 35,000 centipoise, preferably between 10,000 and 20,000 centipoise. The reservoir 2 defines a volume for storing the product.

The reservoir can be made with glass or plastics such as PET, PETG, PMMA, PE or PP. Preferably the reservoir is made of PP so that it can be recycled together with the cap.

The reservoir 2 has a neck 5 made in one piece with the reservoir 2, the neck having threads 5*a* as the cap fastening mechanism on the outer face of the neck 5.

The reservoir 2 has a protrusion 6, and at least top part 6*a* of the protrusion 6 is protruded upward from the outlet orifice of the neck 5. Preferably, the protrusion 6 has a substantially tubular shape, and is housed inside the neck 5. The protrusion 6 has a top part 6*a* which has a cylindrical shape, and a bottom part 6*b* which preferably is substantially frustoconical. This frustoconical bottom part 6*b* is expected to remove excess product which naturally adheres to the outer surface of the pipette 4 (wiping function). Preferably the protrusion 6 also has a snap fit 6*c* as the piston engaging mechanism at outer side of the top part 6*a*. The reservoir 2 has an outlet orifice at the upper end of the protrusion 6. Preferably, the protrusion is formed by a separate insert pressed fit to the reservoir outlet orifice. Preferably such insert is using a thermoplastic plastic and more preferably LLPDE.

The cap 3 is composed of various coaxial components, in this case, an outer cover 7, a cap insert 8 as the corresponding fastening mechanism, a button 10, a piston 11, a housing 9 for piston, protrusion receiver 12, snap fit 13 as the corresponding engaging mechanism, a chamber 14, a gasket 15, and a pipette 4 which makes it possible to draw the product contained in the reservoir 2. Some of these parts can be integrated into one piece, for example, two or three of the following could be in one piece: outer cover 7, cap insert 8, housing 9, and button 10. Alternatively, or concurrently, the following could be in one piece: pipette 4 and piston 11.

The outer cover 7 preferably has a hollow cylindrical shape, and accommodates all of the abovementioned elements numbered 4 and 7-15). The outer cover can be made in ABS or PP. Preferably the outer cover is made in PP to make the cap recyclable.

The top of the cover 7 has an orifice that is able to let through the button 10, which is elastically deformable when pressed along the axis of the dispenser 1. The button 10 is secured to the outer cover 7. Preferably the button is realized out of compliant materials both able to easily deform when pressed as well as having sufficiently strong bounce back to recover its original position. The button material is preferably inert and compatible with the product formulation and have a low moisture vapor transmission rate (MVTR) to minimize water loss from the product and extend the usable life of the product. Preferably, the button can be made in NBR, SBR, EPDM or TPE. More preferably the button can be made of an elastomer material compatible with the PP recycling stream such as the Milastomer (W600NS) commercialized by Mitsui Chemicals The cap insert 8 is fixed rigidly to the cover 7, for example, by press fitting and/or adhesive bonding. A cylindrical cap insert 8 having a circular section is housed inside the volume defined by the cap 3. It comprises threads 8*a* on its inner face that are able to engage with threads 5*a* on the outer face of the neck 5. Thus, the cap insert 8 allows the cap 3 to be screwed onto the neck 5 in order to close off the reservoir by means of the cap. The cap insert also carries a containment ring 8*b* on its inner face that is able to engage with the piston protrusion receiver 12. Preferably, the cap insert 8 can be made of PP.

The housing 9 can be integrated with the cap insert. Preferably, the housing 9 supports the button 10. The housing 9 also form a rigid wall of the chamber 14. Preferably, the housing can be made of PP.

The pipette 4 has an elongate body with a tubular shape to store the liquid to dispense and a lower end orifice to suck the product during loading and release the liquid during activation of the button. The lower end is preferably tapered to form a reduction in section 4*a* which makes it possible to retain the liquid in the pipette especially when the pipette is out of the reservoir 2. The lower end of the pipette can be bent to improve the product intake and release. The upper side of the pipette preferably forms a shoulder 4*b* which is able to connect the piston 11 via the protrusion receiver 12. The pipette 4 also has an upper end orifice to open to the chamber 14. The pipette can be realized of glass, TPX, PETG, PS or PP. Preferably the pipette is made of metallocene PP and can include a clarifying agent.

The piston 11 is slidably contained within the hollow housing 9 placed upper side of the cap insert 8, and moves up and down when the cap 3 is capped and uncapped on and from the bottle respectively. The piston 11 also seals against the inner surface of the housing 9. In order to seal, the piston 11 is molded so as to have an interference fit with the inside wall of the container or housing 9. Also, the housing inner wall is realized with minimal to zero draft. The piston 11 thus has one or more sealing bands having a wider diameter and designed so as to create a flexible seal between the piston 11 and the housing 9 inner wall. The piston is generally realized of a compliant thermoplastic such as LLDPE, LDPE, HDPE or PP. Preferably the piston is made of PP copolymer grade. Preferably the piston or the housing can include anti-stat or anti-block agents to minimize the sliding friction while keeping a good seal contact pressure.

The piston 11 is connected to the protrusion receiver 12 and the pipette 4 such that they bound to move together vertically, and preferably they can freely rotate relative to each other. The piston 11 is axially movable relative to the button between a high position and a low position in the housing 9 so as to cause the volume of the chamber 14 to vary, and suck up the fluid into the pipette 4. The function of the protrusion receiver 12 is to receive the protrusion 6 of the bottle 2 and move up the piston 11 and pipette 4 directly or indirectly during the closing movement. Preferably, the protrusion receiver 12 is rigidly connected to piston 11 and pipette 4. Preferably, the protrusion receiver can be made of PP.

The snap fit 13 of the cap 3 is configured to engage with the snap fit 6*c* of the reservoir 2, and also configured to move together with the piston 11. The snap fits remain engaged in a cap-closed position and a partially cap-open position, and disengages in an cap-open position. During uncapping, by this snap fit engagement between the corresponding snap fit 13 of the cap 3 and the snap fit 6*c* of the reservoir 2, the piston 11 is pushed down in the housing 9, the volume of the chamber 14 increases. During capping, by this snap fit engagement, the piston 11 is pushed up in the housing 9, the volume of the chamber 14 decreases. Preferably, the snap fit 13 of the cap 3 can also include a rib to generate an audible signal when disengaging from the snap fit 6*c* of the reservoir 2, while such rib is not shown in any figures herein.

The containment ring 8*b* can be formed as a part of the cap insert 8. The containment ring 8*b* presses the snap fit 13 of the cap 3 against the snap fit 6*c* of the reservoir 2 when the cap sits on bottle neck and during the capping and uncapping. The compression force of the containment ring prevents accidental disengagement between the snap fit 13 of the cap 3 and the snap fit 6*c* of the reservoir 2 in the cap-closed and partially cap-open position. During the uncapping, the snap fit 13 of the cap 3 can slide over the containment ring 8*b*. This causes the reduction of the containment pressure exerted by the containment ring 8*b* to the snap fit 13 of the cap 3 and snap fit 6*c* of the reservoir 2, and the snap fits disengage upon application of a slight vertical force by the user.

Figure 2:
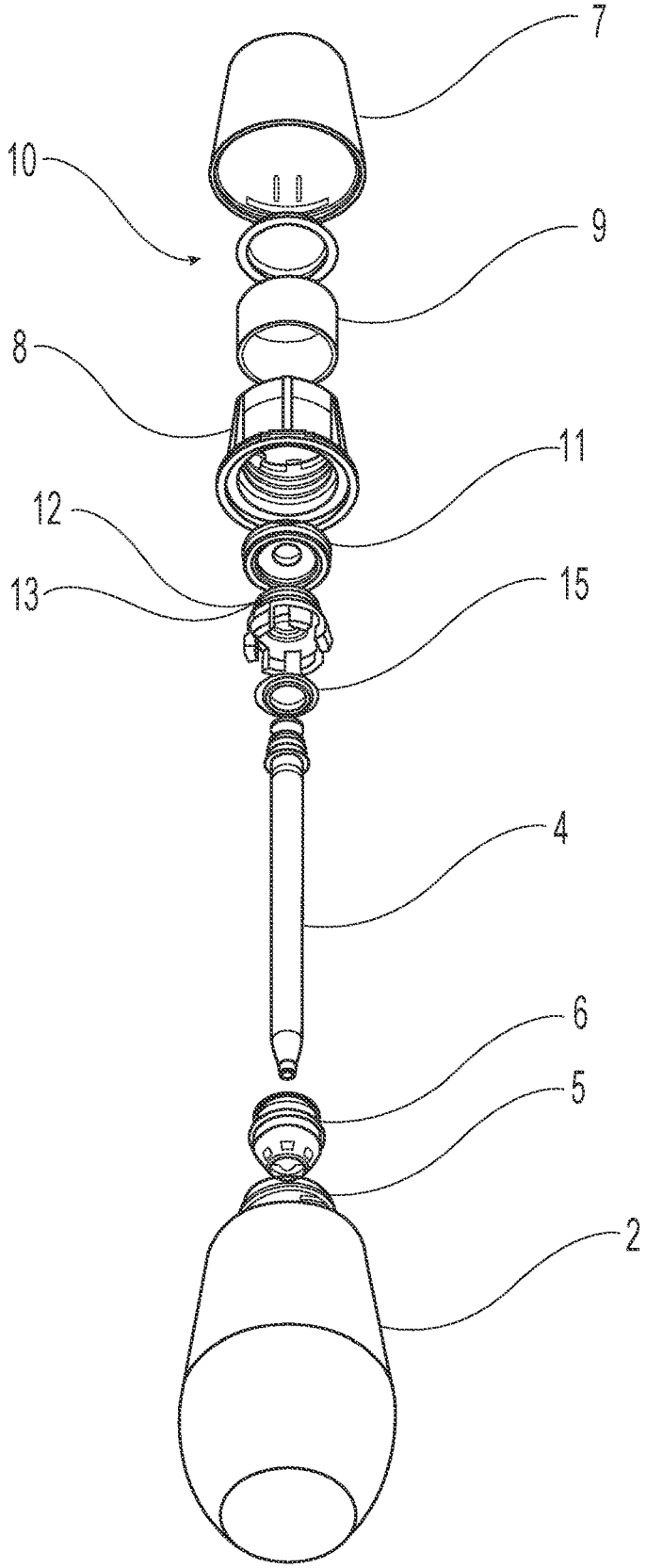
FIG. 2 illustrates an exploded perspective view of the dispenser of FIG. 1.
Figure 3:
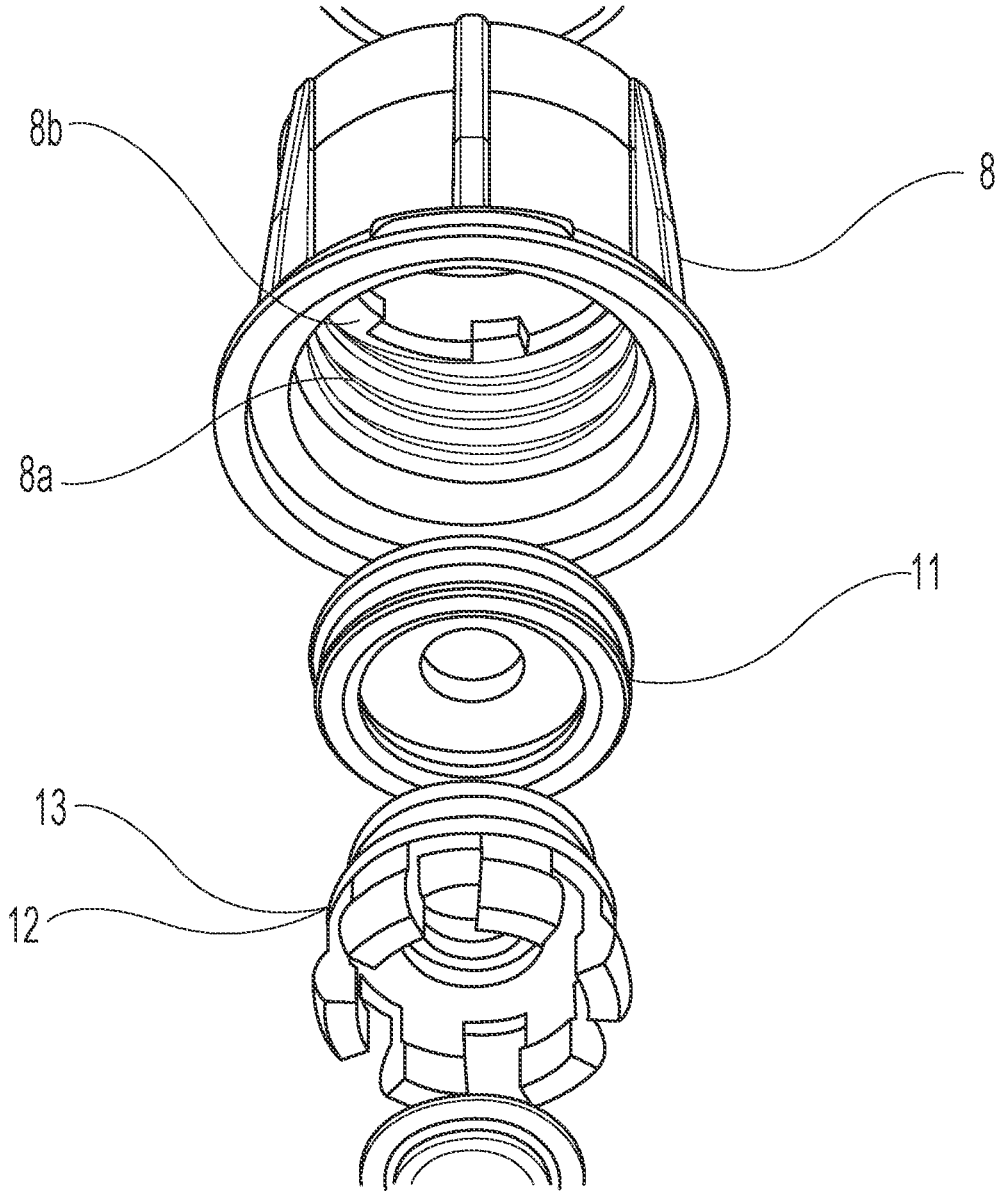
FIG. 3 illustrates an enlarged view of FIG. 2, focusing on some parts of the cap.

FIG. 3 illustrates an enlarged view of FIG. 2, focusing on a certain part of the cap, especially the containment ring 8*b* and some other related parts.

The function of this containment ring 8*b* is to prevent radial expansion of the cantilever snap fit 13 of the cap 3. This prevents the snap fit 13 to disengage from the snap fit 6*c* of the reservoir 2 even if a large vertical pull force is applied. When the cap 3 reaches a certain vertical position, this containment ring 8*b* disengages from the external surface of the snap fit 13. This leaves the snap fit 13 free to radically expand. At this point, a very slight pull is sufficient to disengage the corresponding snap fit 13 of the cap 3 from the snap fit 6*c* of the reservoir 2

The containment ring 8*b* can have some protrusions 8*c* protruded toward to the axis. These protrusions are regularly spaced and designed to fit into at least some of the slots between the cantilever snap fit 13, and in this embodiment, the protrusions of the containment ring fit into all the slots. The key function of this engagement between the protrusions 8*c* and the slots is to minimize the degree of piston rotation relative to the housing while the consumer rotate the cap (in this embodiment, screw and unscrew the cap), to maintain a good seal between the piston and the housing.

The cantilever snap fit 13 having some slots is preferred in view of more bent flexibility of the snap fit 13. This helps minimizing the force needed by the consumer for disengaging the snap fit 13 from the snap fit 6*c* of the reservoir 2. It is preferred that the protrusions 8*c* do not interfere with the snap fit 6*c* of the reservoir 2 when slotted, i.e., the protrusion 8*c* has an inner diameter to have a clearance against the snap fit 6*c* of the reservoir 2.

The gasket 15 is to seal the bottle 2 in a closed position. Preferably, the gasket can be made of laminated foamed PE or foamed PP The chamber 14, is a space formed by the button 10, housing 9, piston 11, and the upper end orifice of the pipette 4. The chamber changes its volume depending on the move of the piston 11 or the movement of the button 10. By this volume change, the pipette 4 sucks up the product or dispense the product from the pipette 4.

While not shown in any figures, the dispenser of the present invention can include an embodiment which does not have any cap fastening mechanism and corresponding fastening mechanism. Such embodiment without cap fastening mechanism and corresponding fastening mechanism can have an almost identical structure to that shown in FIG. 1-7, without the thread 8*a* at the cap insert 8 and thread 5*a* at the bottle neck 5. In this embodiment, it is preferred to have an additional means to avoid any leakage and/or drop of the cap 3 from the bottle 2 especially during transportation. Such additional means can be a shrink wrap which wraps the cap and bottle tightly together. Once the shrink-wrap is removed, the cap be open/closed by a simple vertical push. While it is still preferred to have a containment ring, this embodiment can work without any protrusion on the containment ring.

The path of the piston precisely determines the dose of product which is removed by the pipette. The volume of this dose depends on the difference between the maximum and the minimum volume of the chamber 14. The piston outer diameter (OD) and stroke length can be varied in order to adjust the dose to the desired volume. The dose is also repeatable, that is to say that for each removal, the same dose of product is sucked up by the pipette, specifically the volume of the dose not being influenced by the manner in which the user manipulates the cap 3. Preferably the volume of the dose is between 0.6 and 1 ml.

The operation of the dispenser is explained in FIG. 4-FIG. 7. It is assumed that the dispenser 1 is filled with a viscous product.

Figure 4:
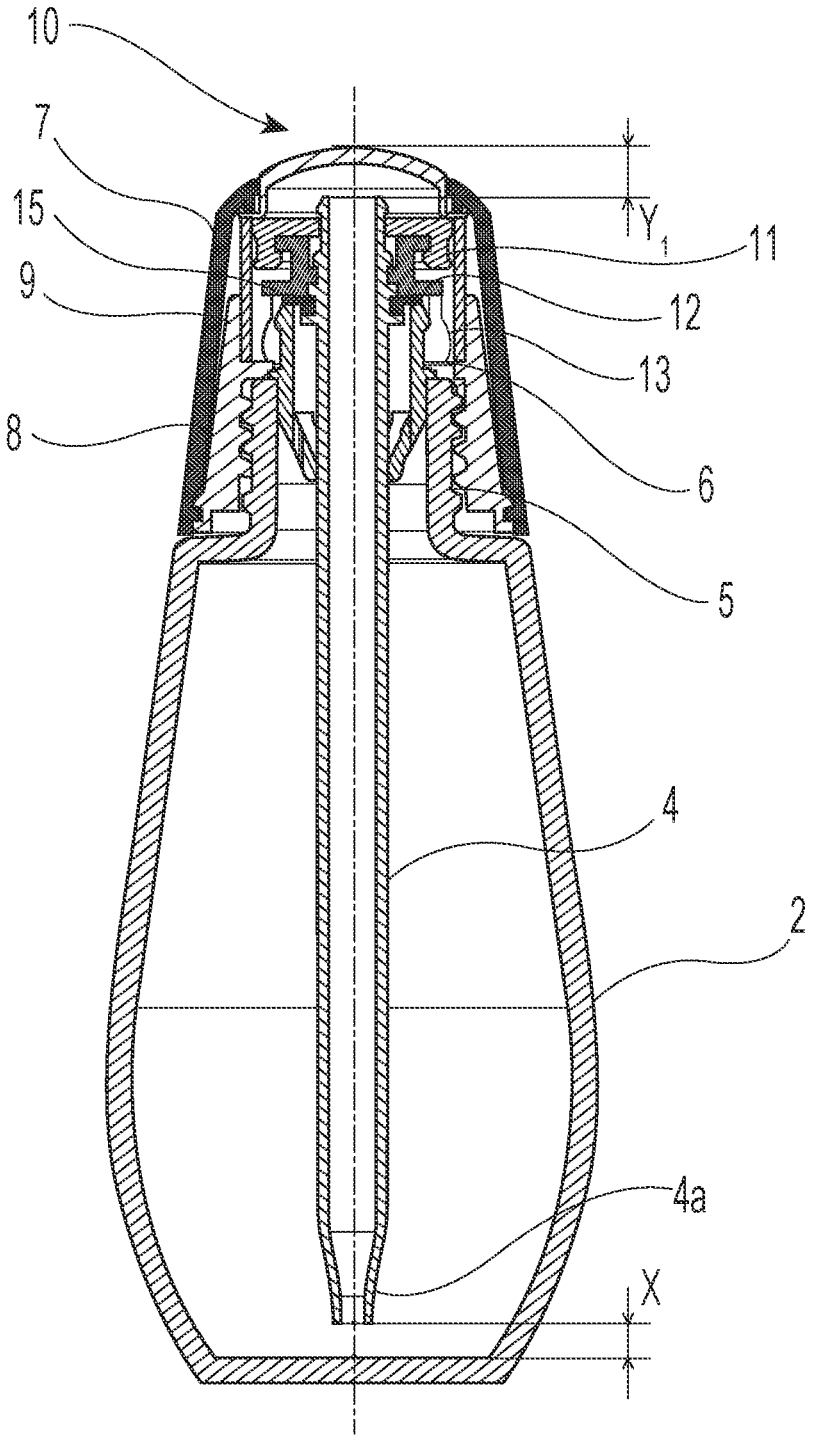
FIG. 4 illustrates a longitudinal cross sectional view of the dispenser of FIG. 1.

FIG. 4 illustrates a longitudinal cross sectional view of the dispenser of FIG. 1, in a cap-closed position. In this position, the cap 3 is fully threaded on the bottle 2, the protrusion snap fit 6*c* engages with the corresponding snap fit 13*a*, the piston is at the high position in the housing, the chamber has reduced volume.

Figure 5:
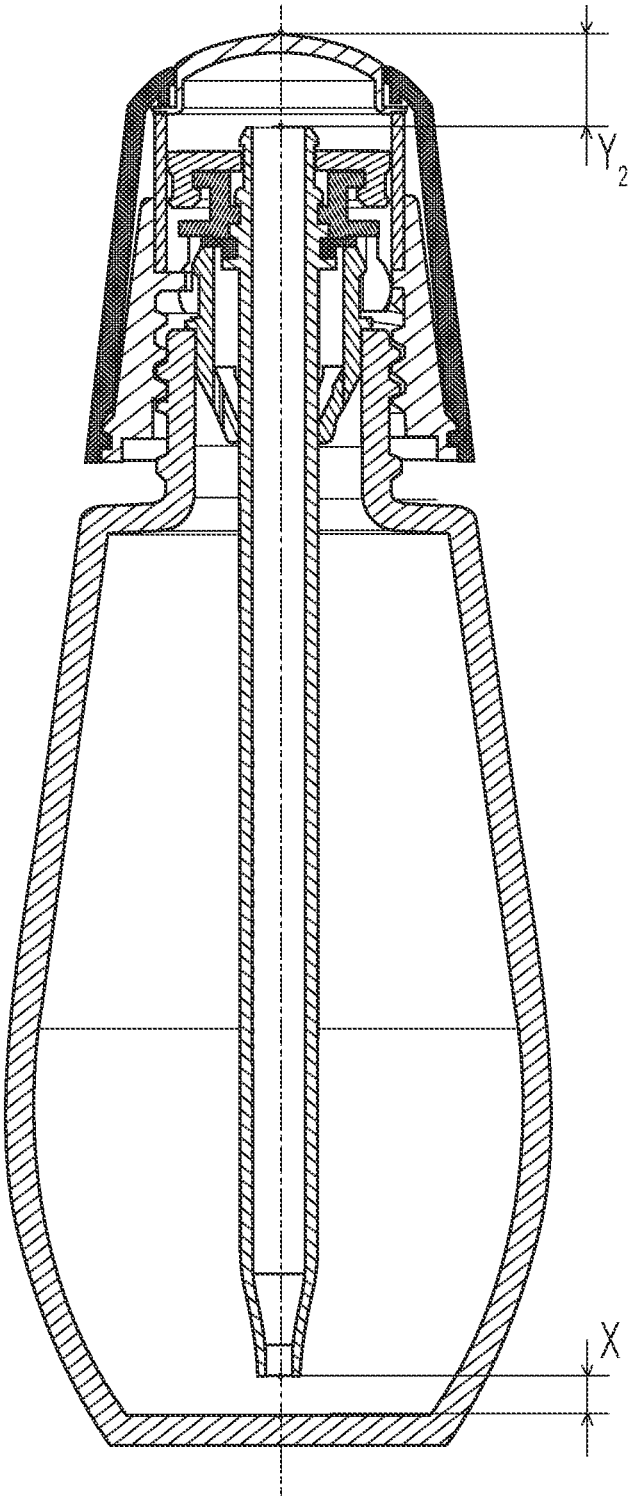
FIG. 5 illustrates a longitudinal cross sectional view of the dispenser of FIG. 1, in a partially cap-open position.

FIG. 5 illustrates a longitudinal cross sectional view of the dispenser of FIG. 1, in a partially cap-open position when the user started to uncap (in this case, unscrew the cap) but have not yet finished uncapping (in this case, unscrewing). The cap insert 8 remains engaged with the neck 5 of the reservoir 2 at this stage. In this position, the cap starts to be unscrewed, but the protrusion snap fit 6*c* still engages with the corresponding snap fit 13. Since the corresponding snap fit 13, the gasket 15, protrusion receiver 12, the piston 11 and the pipette 4 are all rigidly connected, the unscrewing with the engagement between the protrusion snap fit 6*c* and the corresponding snap fit 13*a* makes the piston 11 and the pipette 4 moves down in the housing 14 while not changing the position of the button 10, thus makes the volume of the chamber 14 increase. This increase of chamber volume results in the product being sucked up to the pipette 4.

Figure 6:
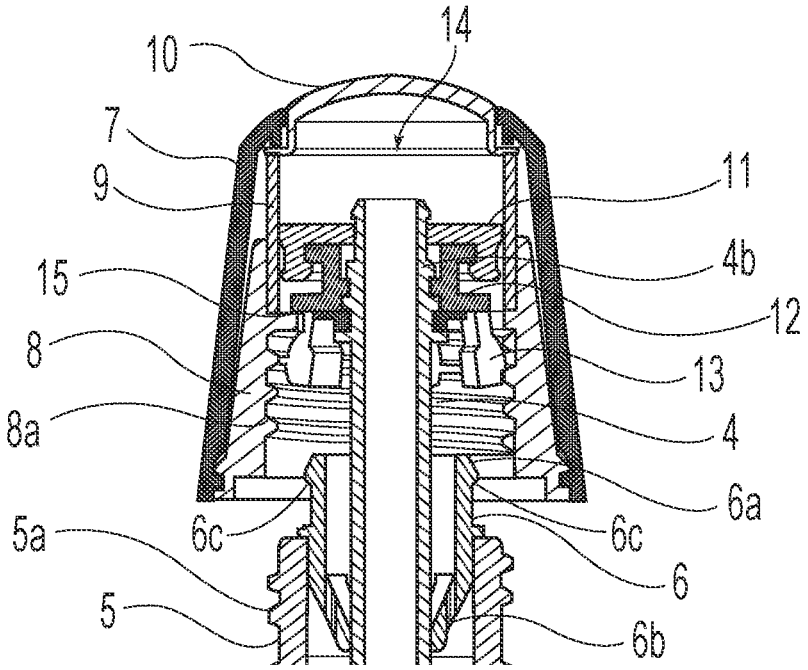
FIG. 6 illustrates a longitudinal cross sectional view of the dispenser of FIG. 1, in an cap-open position, focusing on the cap and reservoir neck portion.

FIG. 6 illustrates a longitudinal cross sectional view of the dispenser of FIG. 1, in a cap-open position.

When the cap insert threads 8*a* disengage with the bottle neck threads 5*a*, it is preferred that the protrusion snap fit 5*a* is still engaged with the stopper snap fit 13*a*. In such case, the snap fit engagement is designed to generate a click sound when disengaged by a gentle pull by the user, so that the user can confirm that the cap is fully disengaged from the bottle and/or a dose is ready to be dispensed.

In this configuration, the volume of the chamber 14 is maximum and the pipette is charged with the product.

When the user continues to rotate the cap in order to open the dispenser, the cap insert 8 to be unscrewed from the neck 5. The assembly formed by the cover 7, the cap insert 8, housing 9, the button 10, the piston 11, protrusion receiver 12, snap fit 13 and gasket 15 and the pipette 4 moves in one piece in rotation about the axis. Therefore, in accordance with FIG. 5, the cap 3 is unscrewed from the neck 5 along the threads 8*a*, the cap 3 being released from its screwed or cap-closed position and thereby allowing the user to remove the cap 3 and its pipette 4 from the dispenser 1.

Figure 7:
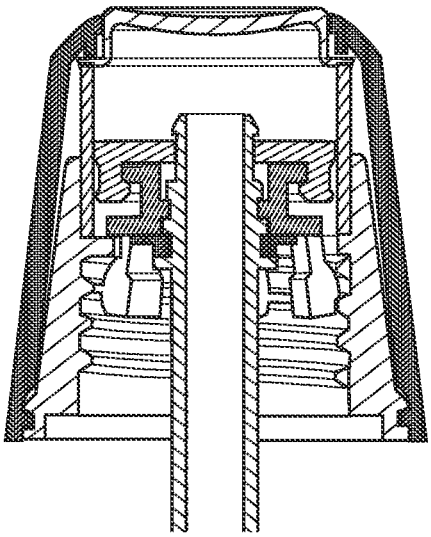
FIG. 7 illustrates longitudinal cross sectional view of the dispenser of FIG. 6, focusing on the cap, in a state that the button is pressed at least partially during an operation of dispensing.

FIG. 7 illustrates longitudinal cross sectional view of the dispenser of FIG. 6, in a state that the button 10 is pressed at least partially during an operation of dispensing. The product loaded inside the pipette 4 is dispensed by pushing the button 10 with respect to the cover 7. This pressing the button 10 does not change the position of piston 11 and pipette 4, thus, makes the chamber volume decrease and causes the ejection of the product which was contained in the pipette 4.

Then, the cap 3 is screwed back on the reservoir 2 until the dispenser 1 has been completely closed off, i.e., in the cap-closed position as shown in FIG. 1 and FIG. 4. At this stage, the cap starts to be screwed, the cap insert 8 starts to engage with the neck 5 of the reservoir 2. The protrusion 6 starts to push the protrusion receiver 12. As protrusion receiver 12, the piston 11 and the pipette 4 are all rigidly connected, the screwing the cap 3 makes the piston 11 and the pipette 4 move up in the housing 14 thus makes the volume of the chamber 14 decrease.

Figure 8:
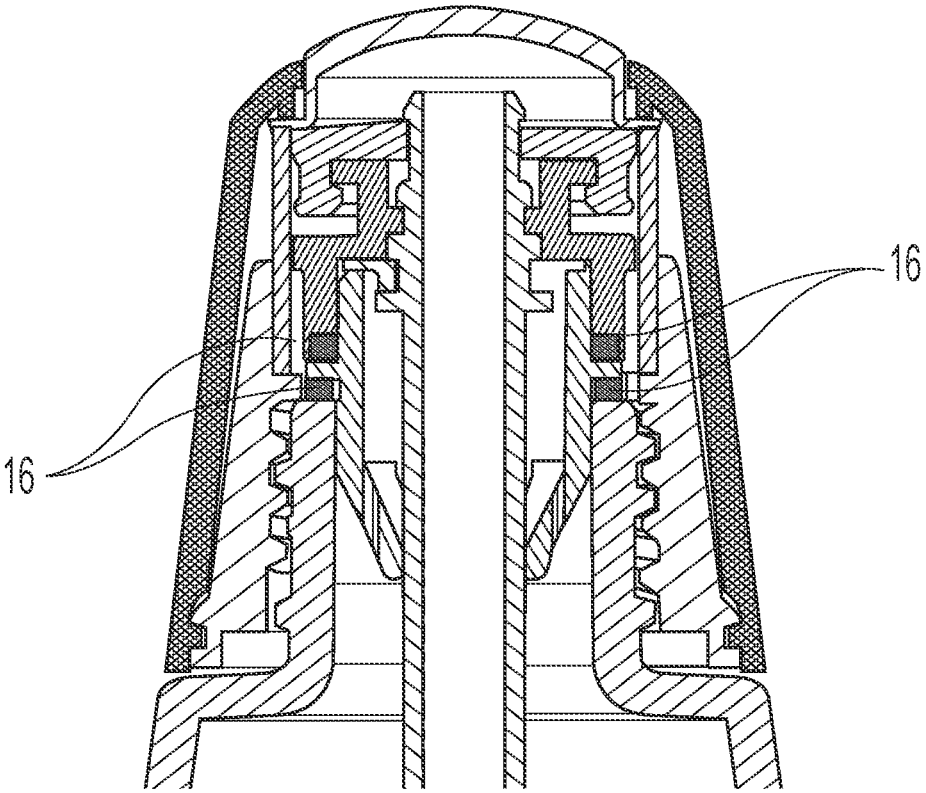
FIG. 8 illustrates a longitudinal cross sectional view of a dispenser according to another embodiment of the present invention, in a closed position, focusing on the cap and reservoir neck portion, wherein the key difference from the embodiments shown in FIG. 1-7 is the use of magnets as the piston engaging mechanism and the corresponding mechanism.

FIG. 8 illustrates a longitudinal cross sectional view of a dispenser according to another embodiment of the present invention, in a closed position, wherein the key difference from the embodiments shown in FIG. 1-6 is the use of magnets 16 as the piston engaging mechanism and the corresponding mechanism. The magnetic force should be high enough to overcome the friction force of the piston during unscrewing, but low enough such that the user can break it by a slight vertical pull. However, it may be preferred that the dispenser is free of magnets in view of mechanical recycling.

Figure 9:
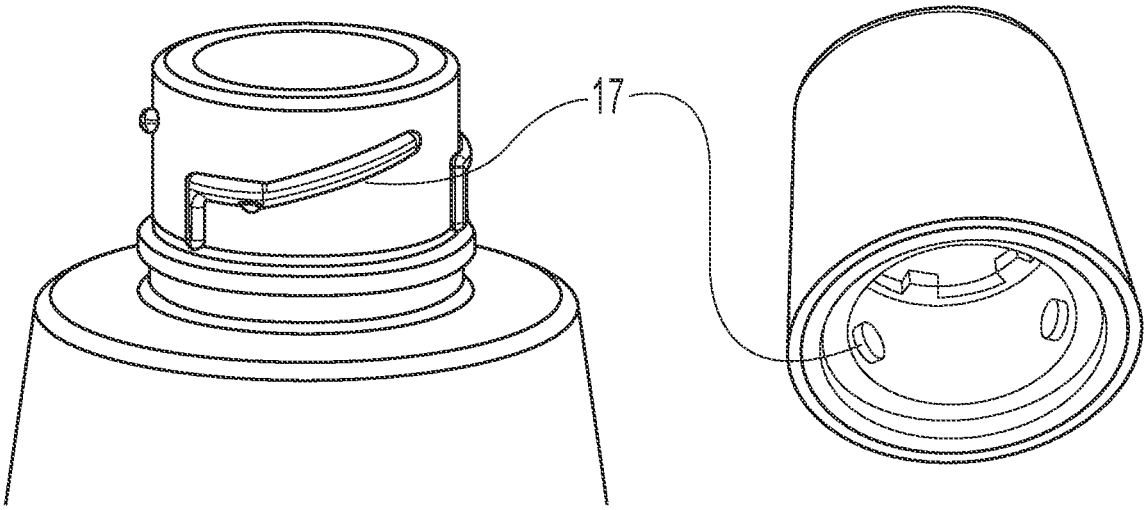
FIG. 9 illustrates a bayonet connecter as an alternative cap fastening mechanism and corresponding mechanism, focusing on such mechanisms while abbreviating other key elements such as protrusion, piston engaging mechanism, corresponding engaging mechanism, piston, housing, and pipette.

FIG. 9 illustrates a bayonet connecter 17 as an alternative cap fastening mechanism and corresponding mechanism, while abbreviating other key elements such as protrusion, piston engaging mechanism, corresponding engaging mechanism, piston, housing, and pipette.

Figure 10:
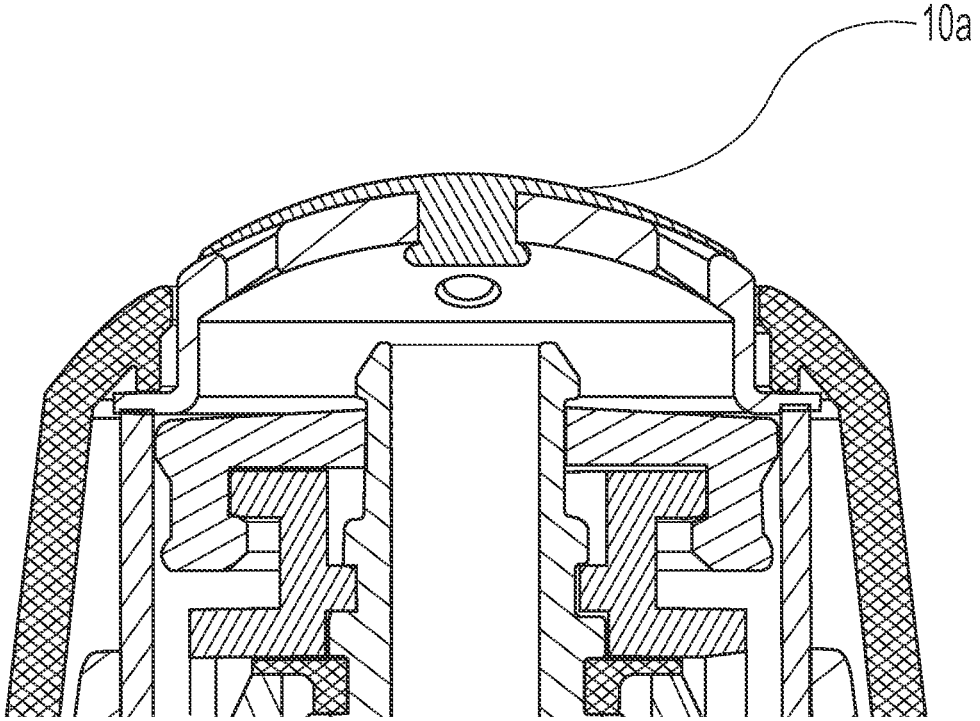
FIG. 10 illustrates an enlarged longitudinal cross sectional view of a dispenser according to another embodiment of the present invention, in a closed position, focusing on a certain part of the cap, wherein the key difference from the embodiments shown in FIG. 1-7 is the addition of the one way valves.

FIG. 10 illustrates an enlarged longitudinal cross sectional view of a dispenser according to another embodiment of the present invention, in a closed position, focusing on a certain part of the cap, wherein the key difference from the embodiment shown in FIG. 1-7 is the addition of the one way valves 10*a* in the button 10 which is to release an air when the piston moves from a lower position to a higher position in the housing, i.e., to vent air included in the pipette and chamber during capping in a direction of closing the product dispenser. Without this air release mechanism, the pipette may start venting air into the reservoir during capping after dispensing, the air may create a temporary air pocket around the pipette lower end orifice which may be sucked up in next loading or later, thus, it may cause les precise dispensing next time or later especially when the product having a higher viscosity.

In this one way valve 10*a*, a soft valve flexes out to release a trapped air in the chamber and/or pipette through paths shown in FIG. 10, as the piston moves up when capped onto the reservoir after dispensing.

The one-way valve can be anything, for example, conventional, flexible, resilient, low-pressure one-way valves such as a flap, umbrella, duck-bill, ball or disk valve. Alternatively, the one way valve may be provided by a vent on a part of the button surface that is covered by a user's finger or hand on actuation and uncovered on release. More preferably, the one-way valve consists of one or more umbrella valves.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A product dispenser, comprising:

a reservoir for a product, having: a protrusion; and a piston engaging mechanism, a cap having the followings:

a pipette having an upper end orifice and a lower end orifice;

a piston configured to move so as to create a suction to draw the product through the lower end orifice of the pipette of the product dispenser;

a housing for the piston configured for the piston to slide between a high position and low position in the housing;

a corresponding engaging mechanism configured to engage with the piston engaging mechanism of the reservoir, and also configured to move together with the piston; wherein the piston engaging mechanism and the corresponding engaging mechanism are snap fits;

a button configured to dispense the product through the lower end orifice of the pipette, when the button is actuated;

a chamber configured to change volume depending on the movement of the piston and the movement of the button, wherein when the cap is capped on the reservoir in a direction of closing the product dispenser, the piston is moved by the protrusion, relatively to the housing to the high position in the housing, and the volume of the chamber decreases, wherein when the cap is uncapped on the reservoir in a direction of opening the product dispenser, the piston is moved relatively to the housing to the low position in the housing by the engagement of the piston engaging mechanism and the corresponding engagement mechanism, and the volume of the chamber increases, wherein opening the cap produces a suction of the product in the pipette, wherein when the button is actuated, the volume of the chamber decreases by which the product is dispensed from the pipette.

2. The product dispenser according to claim 1, wherein the reservoir further comprises a neck having an outer surface with a cap fastening mechanism formed on the outer surface, and wherein the protrusion is protruded upward from the neck.

3. The product dispenser according to claim 1, wherein the protrusion has the piston engaging mechanism.

4. The product dispenser according to claim 1, the cap also has a containment ring configured to help engaging the corresponding engaging mechanism with the piston engaging mechanism by containment pressure.

5. The product dispenser according to claim 1, wherein the reservoir also has a cap fastening mechanism, and the cap also has a corresponding fastening mechanism configured to engage with the cap fastening mechanism on the reservoir.

6. The product dispenser according to claim 5, wherein the cap fastening mechanism and the corresponding fastening mechanism are screw threads.

7. The product dispenser according to claim 5, wherein the cap fastening mechanism and the corresponding fastening mechanism are screw threads.

8. The product dispenser according to claim 1, wherein the button has a valve to release air when the piston moves from the low position to the high position in the housing.

9. The product dispenser according to claim 1, wherein the product dispenser is free of coil spring and bellows.

10. The product dispenser according to claim 1, wherein the protrusion has the piston engaging mechanism.

11. The product dispenser according to claim 1, wherein the reservoir also has a cap fastening mechanism, and the cap also has a corresponding fastening mechanism configured to engage with the cap fastening mechanism on the reservoir.

12. The product dispenser according to claim 1, wherein the button has a valve to release air when the piston moves from the low position to the high position in the housing.

13. A product dispenser, comprising:

a reservoir for a product, having: a protrusion; and a piston engaging mechanism, a cap having the followings:

a pipette having an upper end orifice and a lower end orifice;

a piston configured to move so as to create a suction to draw the product through the lower end orifice of the pipette of the product dispenser;

a housing for the piston configured for the piston to slide between a high position and low position in the housing;

a corresponding engaging mechanism configured to engage with the piston engaging mechanism of the reservoir, and also configured to move together with the piston;

a button configured to dispense the product through the lower end orifice of the pipette, when the button is actuated;

a chamber configured to change volume depending on the movement of the piston and the movement of the button, wherein when the cap is capped on the reservoir in a direction of closing the product dispenser, the piston is moved by the protrusion, relatively to the housing to the high position in the housing, and the volume of the chamber decreases, wherein when the cap is uncapped on the reservoir in a direction of opening the product dispenser, the piston is moved relatively to the housing to the low position in the housing by the engagement of the piston engaging mechanism and the corresponding engagement mechanism, and the volume of the chamber increases, wherein opening the cap produces a suction of the product in the pipette, wherein when the button is actuated, the volume of the chamber decreases by which the product is dispensed from the pipette;

wherein the product dispenser is free of coil spring and bellows.

14. The product dispenser according to claim 13, wherein the reservoir further comprises a neck having an outer surface with a cap fastening mechanism formed on the outer surface, and wherein the protrusion is protruded upward from the neck.

15. The product dispenser according to claim 13, wherein the piston engaging mechanism and the corresponding engaging mechanism are snap fits.

16. The product dispenser according to claim 15, the cap also has a containment ring configured to help engaging the corresponding engaging mechanism with the piston engaging mechanism by containment pressure.

* * * * *